US007810188B2

(12) United States Patent
Barthelt

(10) Patent No.: US 7,810,188 B2
(45) Date of Patent: Oct. 12, 2010

(54) NURSING BED WITH IMPROVED LIFTING MECHANISM

(76) Inventor: Hans-Peter Barthelt, Hegensbergerstr. 132, 73732 Esslingen (DE)

( * ) Notice: Subject to any disclaimer, the term of this patent is extended or adjusted under 35 U.S.C. 154(b) by 937 days.

(21) Appl. No.: 11/587,334

(22) PCT Filed: Mar. 31, 2005

(86) PCT No.: PCT/EP2005/003355

§ 371 (c)(1),
(2), (4) Date: Jan. 19, 2007

(87) PCT Pub. No.: WO2005/105011

PCT Pub. Date: Nov. 10, 2005

(65) Prior Publication Data

US 2007/0174968 A1 Aug. 2, 2007

(30) Foreign Application Priority Data

Apr. 21, 2004 (DE) ..... 10 2004 019 144

(51) Int. Cl.
*A61G 7/012* (2006.01)
*A61G 7/015* (2006.01)
*A61G 7/018* (2006.01)

(52) U.S. Cl. ..... 5/611; 5/11; 5/613

(58) Field of Classification Search ..... 5/611, 5/11, 600, 613, 616, 118
See application file for complete search history.

(56) References Cited

U.S. PATENT DOCUMENTS 3,298,654 A * 1/1967 Dome ..... 248/567
3,937,443 A * 2/1976 Durgan ..... 254/10 B
4,159,822 A * 7/1979 Ota et al. ..... 5/614
4,227,269 A * 10/1980 Johnston ..... 5/611
4,685,159 A * 8/1987 Oetiker ..... 5/608
4,959,957 A 10/1990 Schmale et al.
4,979,248 A * 12/1990 Kelley ..... 5/118
5,022,105 A * 6/1991 Catoe ..... 5/11
5,365,622 A * 11/1994 Schirmer ..... 5/611
5,598,591 A * 2/1997 Kelley ..... 5/118
6,493,886 B1 * 12/2002 Vanpage et al. ..... 5/118
6,654,973 B2 * 12/2003 Van Den Heuvel et al. ..... 5/611
6,868,567 B2 * 3/2005 Edgerton ..... 5/611
7,373,677 B2 * 5/2008 Barthelt ..... 5/618

(Continued)

FOREIGN PATENT DOCUMENTS

CN 2050755 U 1/1990

(Continued)

*Primary Examiner*—Robert G Santos
(74) *Attorney, Agent, or Firm*—Leydig, Voit & Mayer, Ltd.

(57) ABSTRACT

A height-adjustable nursing bed is provided that includes a pedestal in which the upper frame and the lower frame are connected to one another by a total of four toggle lever pairs. The toggle lever pairs on each side of the bed are additionally connected to one another by horizontally and diagonally extending coupling braces. The horizontal coupling brace connects the toggle levers in the region of the toggle link while the diagonal coupling brace connects a lower toggle lever arm to an upper toggle lever arm. The motor for raising and lowering the upper frame relative to the lower frame extends directly between these two frames such that the toggle levers and their coupling braces act as a parallel linkage of sorts.

12 Claims, 4 Drawing Sheets

U.S. PATENT DOCUMENTS

| | | | | |
|---|---|---|---|---|
| 7,520,005 | B2 * | 4/2009 | Barthelt | 5/618 |
| 2004/0055087 | A1 | 3/2004 | Edgerton | |
| 2006/0143828 | A1 * | 7/2006 | Barthelt | 5/618 |
| 2006/0236458 | A1 * | 10/2006 | Barthelt | 5/613 |
| 2007/0174968 | A1 * | 8/2007 | Barthelt | 5/618 |
| 2008/0148485 | A1 * | 6/2008 | Barthelt | 5/611 |
| 2009/0038074 | A1 * | 2/2009 | Barthelt | 5/611 |
| 2010/0017965 | A1 * | 1/2010 | Barthelt | 5/611 |
| 2010/0064441 | A1 * | 3/2010 | Barthelt | 5/616 |
| 2010/0071132 | A1 * | 3/2010 | Barthelt | 5/613 |

FOREIGN PATENT DOCUMENTS

| | | | |
|---|---|---|---|
| DE | 19854136 | A1 | 6/1999 |
| EP | 0349067 | A1 | 3/1990 |
| JP | 05293143 | A | 11/1993 |

* cited by examiner

NURSING BED WITH IMPROVED LIFTING MECHANISM

BACKGROUND OF THE INVENTION

A lifting mechanism for a nursing bed is described in DE 198 54 136 A1. The disclosed lifting mechanism included a frame that forms the pedestal of the lifting mechanism, as well as an upper frame that is arranged approximately congruent with the frame and serves as the lifting head. A total of four levers are provided in the side of the lifting mechanism. Two of the levers are respectively connected to one another by a toggle link. At the toggle links, two toggle lever pairs are kinematically connected to one another by a horizontal coupling brace. Another coupling brace connects one of the upper levers to a lower lever on each side, for example, the upper lever at the foot end of the bed to the lower lever at the head end. One end of the driving motor for moving the lifting mechanism engages a cross brace of the pedestal and the other end engages a connecting brace that connects the two horizontally extending coupling braces to one another.

Viewed from the side, the two lower levers and the horizontal coupling braces form a rod parallelogram that is raised by the spindle motor. The two upper levers also form a parallelogram together with the upper frame or lifting head. This latter parallelogram is raised via the diagonally extending coupling brace.

Due to this kinematic arrangement, an extremely high pressure force acts in the diagonally extending coupling brace. This pressure force does not depend at all on the patient's center of gravity being situated in the vicinity of the levers at the foot end or the levers at the head end. Enormous pressure forces act in the lower lifting range. Since the lower parallelogram is raised by the spindle motor, the forces that need to be generated by the motor are comparatively high when the lifting mechanism is lowered and decrease significantly as the parallelogram is raised. The transmission ratio in the lower lifting range is approximately 2:1, i.e., the lifting mechanism is stretched by twice the amount by which the motor is displaced. In contrast, the lifting ratio is reversed in the upper range. As a result, the lifting mechanism can only be raised very slowly in the upper lifting range.

BRIEF SUMMARY OF THE INVENTION

In view of the foregoing, a general object of the invention is to develop a lifting mechanism having a more favorable load distribution.

The nursing bed according to the invention features a lifting mechanism that includes a pedestal and a lifting head. A multi-part mattress frame is situated on the lifting head. Each side of the lifting mechanism is provided with a lever at both the head end and the foot end, each of which is coupled to the pedestal. The upper end of each lever is connected to another lever that connects the respective lower lever to the lifting head. The lever pairs on each side of the lifting mechanism are coupled to one another by a horizontal coupling brace. Another coupling brace connects one lower lever to one upper lever on each side with one lever being arranged at the foot end and the other lever being arranged at the head end. The linear drive extends between the pedestal and the lifting head.

This arrangement produces entirely different kinematics as compared to conventional nursing bed lifting mechanisms. Conventional lifting mechanisms essentially consist of two parallelograms that are stacked on top of one another with each parallelogram being is raised by a separate drive that is either in the form of a linear drive or a diagonal coupling brace. In the arrangement according to the present invention, the lever mechanism acts like a parallel linkage. It absorbs the horizontal forces occurring during the lifting process similar to a parallel linkage.

According to the invention, the force occurring in the diagonal coupling brace is dependent on the position of the patient's center of gravity. If the patient lies centrally between the lifting pair at the head end and the lifting pair at the foot end, the force in the diagonal coupling brace amounts to less than half that occurring in conventional arrangements. This significantly reduces the load in the joints that connect the diagonal coupling brace and the horizontal coupling brace to the levers.

Under a load, a pressure force acts in the horizontal coupling brace if the horizontal coupling brace is arranged somewhat crosswise to the orientation of the linear drive. The corresponding tensile forces occur in the horizontal coupling brace. Tension and compression are interchanged once the diagonal coupling brace lies approximately parallel to the orientation of the linear drive. The pressure force under a load then acts in the horizontal coupling brace. Nevertheless, the load distribution is as before with the engagement of the linear drive on the lifting head resulting in an improved state of the forces in the pressure brace, which, in turn, can be designed with smaller dimensions. This naturally also applies to the joints. This is particularly important because the coupling of the diagonal coupling brace to the levers is an unsupported coupling, i.e., the hinge axes that connect the two structural elements to one another are not only subjected to shearing stress, but also to bending stress.

A comparison between the force when the lifting mechanism is lowered and the force when the lifting mechanism is raised shows that the altered kinematics also produce an improvement of the motor load. In contrast to conventional arrangements in which the transmission ratio is highly nonlinear and changes from a speed increasing ratio to a speed reducing ratio, with the present invention the transmission ratio remains a speed increasing ratio, however, with a reduced force, when the lifting mechanism is lowered.

In addition, an unexpected result of the arrangement according to the invention is that linear drives with the same travel as in conventional arrangements can also be used in the inventive arrangement so long as the same lifting height needs to be reached.

The inclination of the lifting head relative to the pedestal under a one-sided lateral load can be significantly reduced if at least two corresponding levers are connected to an element that suppresses torsion between the levers on both sides of the lifting mechanism.

Pinching points can be largely eliminated if the levers are inwardly offset relative to the pedestal and the lifting head, respectively. This also enables the lifting mechanism of the invention to be used without an outer lining.

It is preferred that the pedestal and the lifting head be respectively formed by a rectangular frame, the longitudinal members and cross members of which are formed of a rectangular frame whose longitudinal members and cross members preferably consist of rectangular tubes.

The pedestal contains a cross brace that serves as an abutment for the linear drive. The linear drive preferably comprises a spindle motor. A spindle motor provides the advantage of being self-locking such that the lifting mechanism stops in the adjusted lifting position as soon as the current for the motor is switched off.

DETAILED DESCRIPTION OF THE INVENTION

Figure 1:
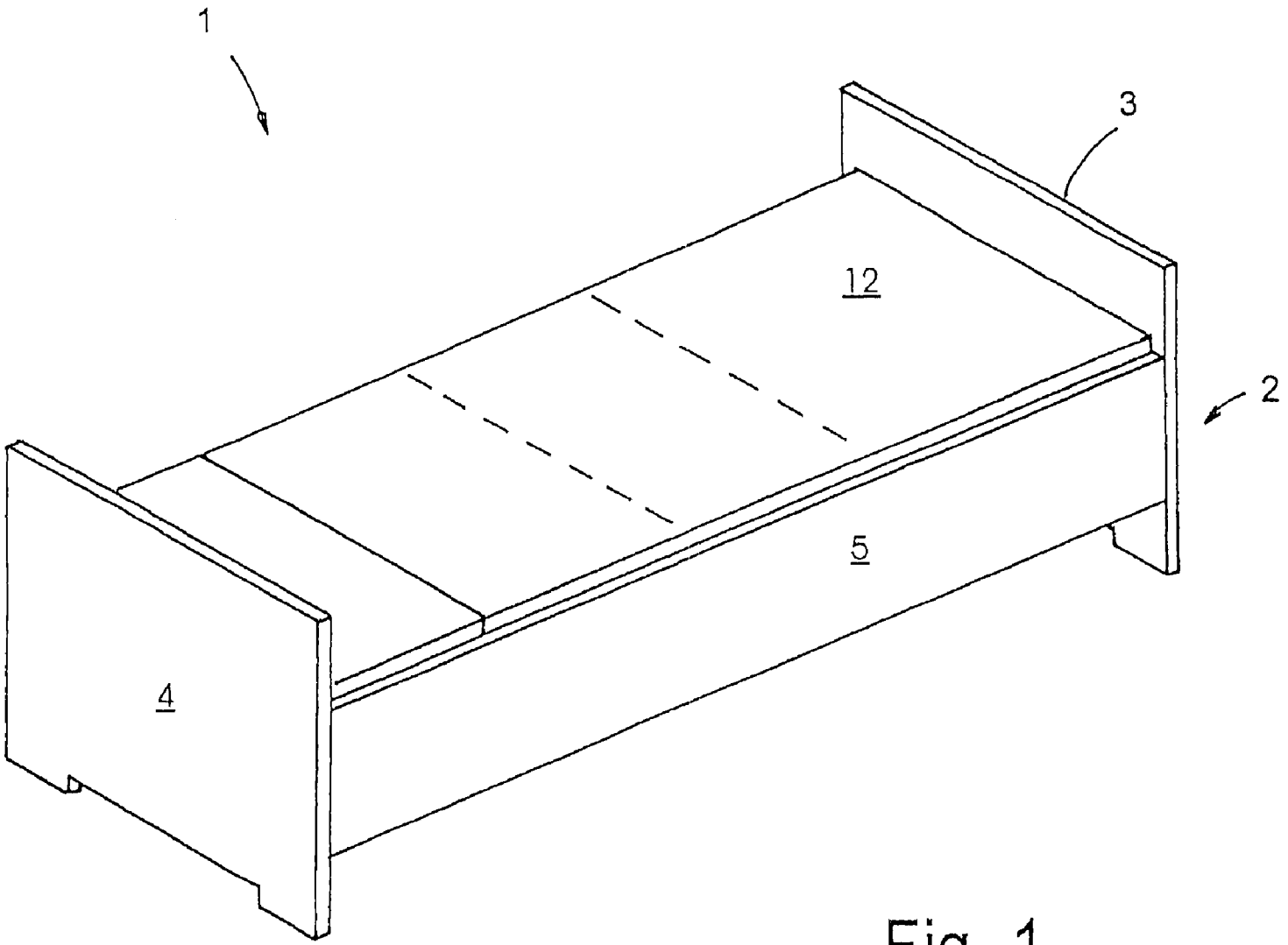
FIG. 1 is a perspective view of an exemplary rotary bed according to the present invention in the reclined position.
Figure 2:
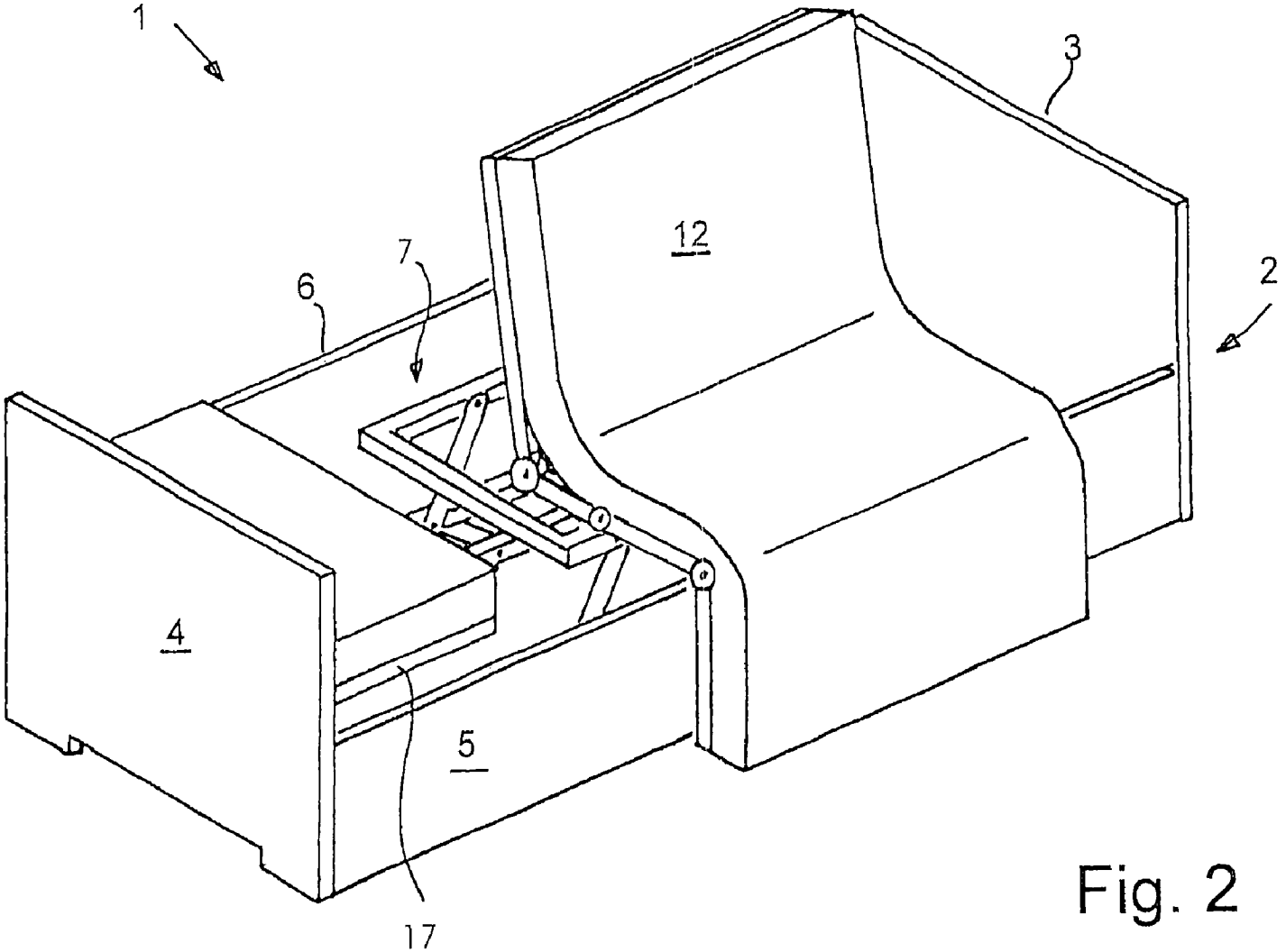
FIG. 2 is a perspective view of the rotary bed of FIG. 1 in the chair or sitting position.

Referring to FIGS. 1 and 2 of the drawings, an illustrative nursing bed 1 according to the invention is shown in the reclined position (FIG. 1) and in the sitting or chair position (FIG. 2). The nursing bed 1 includes a bed frame 2 with a head part 3, a foot part 4 as well as side walls 5 and 6. The outward facing side wall 5 (with reference to FIGS. 1 and 2) is in the raised position as reflected by the distance of the side wall 5 from the floor. The gap between the underside of the side wall 5 and the floor enables the nursing personnel to place the forward section of their feet underneath the bed. The side wall 5 is movably supported and displaced downward in the chair position of the nursing bed 1 as shown in FIG. 2. The support of the side wall 5 is explained in detail, for example, in DE 199 12 937 A1, the disclosure of which is incorporated herein by reference.

Figure 3:
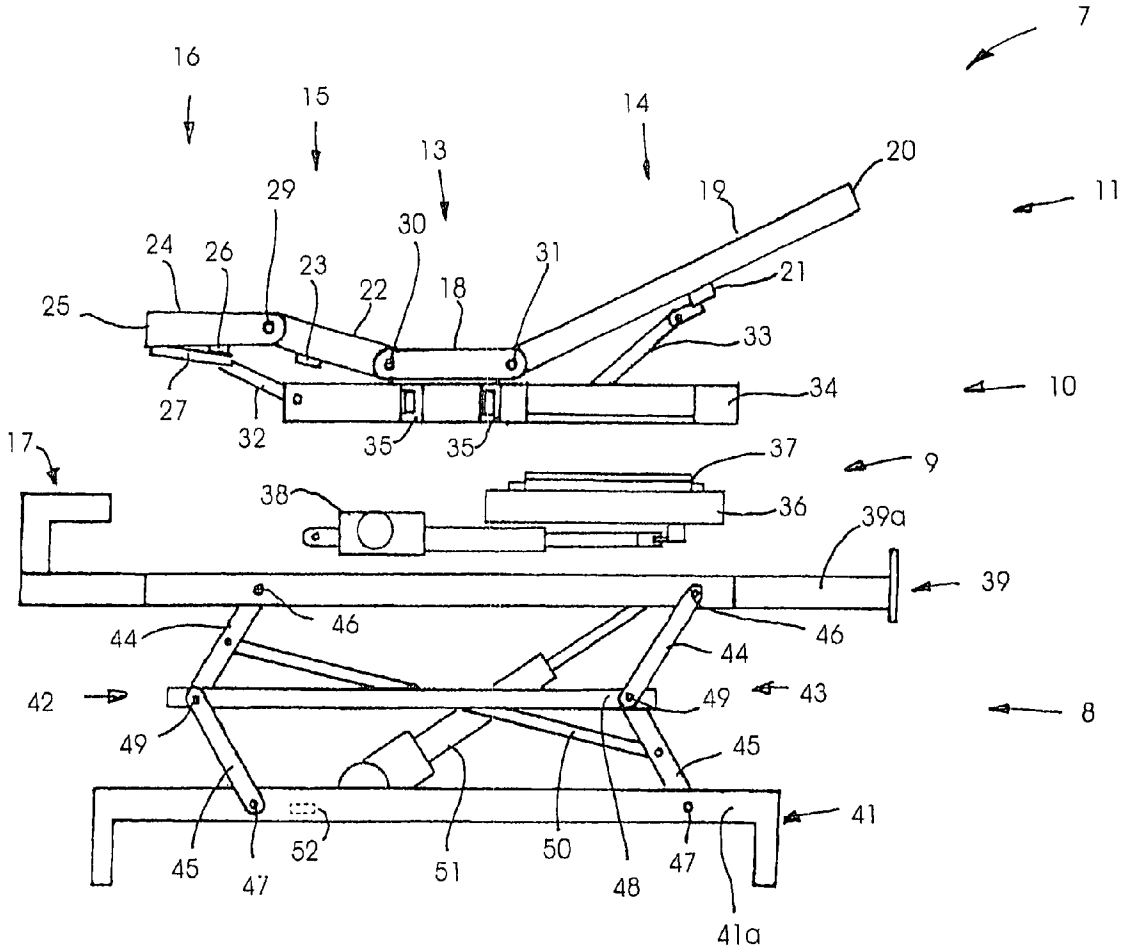
FIG. 3 is a partially exploded side view of the bed lifting mechanism of the rotary bed of FIG. 1.

A bed lifting mechanism 7 is situated within the bed frame 2 as shown in FIG. 3. The bed lifting mechanism 7 comprises a height-adjustable pedestal 8, an intermediate frame 10 as well as a bed frame 11 with a mattress 12 lying thereon. A rotary hinge 9 with a vertical axis of rotation is mounted on the upper side of the pedestal 8. If viewed from the top, the bed frame 11 has a rectangular shape.

The bed frame is divided into a central section 13 that is rigidly connected to the intermediate frame 11, a back section 14 that is hinged to the central section 13, a thigh section 15 that is also hinged to the central section 13, as well as a lower leg section 16. The lower leg section 16 is hinged to the opposite end of the thigh section 15 relative to the central section 13. The hinge axes, about which the sections 14, 15, 16 can be pivoted relative to the central section 13, extend horizontally. The bed frame 12 also features a foot section 17 that is directly and rigidly connected to the pedestal 8.

The central section 13 of the bed frame 12 features two longitudinal rails 18 that extend parallel to one another and are spaced apart from one another in accordance with the width of the nursing bed 1. In FIGS. 1 and 2, the visible longitudinal rail 18 covers the other corresponding longitudinal rail of the central section 13. Each of these rails 18 ends at the hinge brackets for a hinge. The design of the hinge is described in DE 102 50 075 A1. This publication is incorporated by reference herein by reference. Each rail 18 carries pins 31 that point inward. Molded rubber pieces that conventionally accommodate torsion rods can be pushed on these pins. Instead of utilizing torsion rods, the support could also be in the form of a plate as is common practice with hospital beds.

The back section 14 is bordered by a rail 19 and another rail that extends parallel thereto and is not visible in FIG. 3. The rail 19 is hinged to the rail 18 while the other rail is connected to the longitudinal rail extending parallel to the longitudinal rail 18. The two rails 19 of the back section 14 are connected to one another at the upper end at 20 by a cross rail. Another cross brace 21 connects the two longitudinal rails 19 on the underside. The thigh section 15 is also bordered by two longitudinal rails, of which only the longitudinal rail 22 is visible in the drawings. The other longitudinal rail is covered by the longitudinal rail 22. The two longitudinal rails 22 are connected by means of a cross brace 23. The cross brace 23 connects to approximately the center of each longitudinal rail 22 on the underside.

The lower leg section 16 is also bordered by two longitudinal rails, of which only the longitudinal rail 24 is shown in FIG. 3. The two longitudinal rails 24 are connected to one another at the lower end at 25 by a cross brace. The two longitudinal rails 24 are also connected by a brace 26 on which two parallel guide rails 27 are mounted. The guide rails 27 extend as far as the lower end 25. The guide rails are angled relative to the longitudinal rail 24 as shown in FIG. 3, namely such that the guide rails 27 and the longitudinal converge in the direction of the foot end 25. The distance between the two guide rails 27 is significantly smaller than the distance between the two longitudinal rails 24. For example, in comparison with the longitudinal rails 24, the guide rails 27 are inwardly offset by approximately 20 cm.

All of the longitudinal rails 19, 22 and 24 carry pins that point to the center of the bed and serve to connect the longitudinal rails 19, 22 and 24 to molded rubber pieces, between which torsion rods are conventionally arranged. The hinges that connect respectively adjacent longitudinal rails to one another on each side of the bed 1 are schematically illustrated at 29, 30 and 31.

The lower leg section 16 can be raised or lowered by means of an electric motor. The electric motor is coupled to a lever 32 via a gear and is situated in the intermediate frame 10. Another electric motor 33 is supported in the intermediate frame 10 and extends to the cross brace 21. This makes it possible to raise or lower the back section 14.

The two longitudinal rails 18 of the central section 13 are rigidly connected to the intermediate frame 10. The intermediate frame 10 is composed of rectangular tubes that are welded together into a rectangular frame (only one rectangular tube 34 is visible in FIG. 3). The parallel rectangular tube is covered by the rectangular tube 34. The rectangular frame is narrower than the distance between the longitudinal rails 18. A total of four extension arms 35 are welded to the parallel rectangular tubes 34. Two of these extension arms respectively carry a longitudinal rail 18. The extension arms 35 extend horizontally and perpendicular to the longitudinal axis of the nursing bed 1.

The rotary hinge 9 connects the intermediate frame 10 to the height-adjustable pedestal 8. The rotary hinge 9 includes a ring 36 and a pivoted bolster 37 that is rotatably supported in the ring 36. The pivoted bolster 37 is screwed to the intermediate frame by means of screws. The exact design of the rotary hinge 9 is explained in DE 102 50 075 A1, the disclosure of which in incorporated herein by reference. The rotary hinge 9 allows the intermediate frame 10 to be turned about the vertical axis of rotation together with the bed frame 7. The turning motion is produced via an electric motor 38. One end of the electric motor is supported on the lifting mechanism 8 and the other end is supported on the pivoted bolster 37.

The height-adjustable pedestal 8 comprises an upper frame 39 as well as a lower frame 41, both of which consist of rectangular tubes that are welded together accordingly. Two of these rectangular tubes that extend parallel to one another form longitudinal rails 39*a* and 41*a*, respectively. The upper frame 39 is supported on the lower frame 41 by a total of four toggle lever pairs 42 and 43 that are connected to one another. The rotary hinge is connected to the upper frame 39. The toggle lever pairs 42, 43 are respectively situated adjacent to a lateral side of the pedestal 8 such that the corresponding toggle lever pairs 42, 43 on the other side are not visible in FIG. 3. Each toggle lever pair 42, 43 is composed of an upper toggle lever arm 44 and a lower toggle arm 45.

Each toggle lever 42, 43 is connected in an articulated fashion to the upper and the lower frame 39, 41 on the corresponding side of the bed by a hinge 46 with a horizontal axis. All axes of the hinges 46 are arranged axially parallel to one another. The axes of the hinges 46 are arranged coaxial to the axes of the hinges of the toggle levers 42, 43 that cannot be seen in FIG. 3. Hinges 47 connect the toggle lever pairs 42, 43 to the lower frame 41. The axes of the hinges 47 are arranged parallel to the axes of the hinges 46. Moreover, the axes of the hinges 46, 47 that correspond to one another on both sides are arranged coaxial to one another.

The two toggle lever pairs 42, 43 on each side of the pedestal 8 are respectively coupled to one another by a corresponding horizontal coupling brace 48. Each coupling brace 48 is connected to the toggle link 49 of each toggle lever pair 42, 43 in a hinge-like fashion as shown in FIG. 3. A diagonally extending coupling brace 50 connects the upper toggle lever arm 44 of the toggle lever pair 42 to the lower toggle lever arm 45 of the toggle lever pair 43 on each side of the pedestal 8.

An electric motor 51 that is in the form of a spindle motor analogous to the electric motors 33, 38 extends between the upper frame 39 and the lower frame 41. The electric motor 51 is coupled to a cross brace 52 of the lower frame 41 that is indicated with broken lines adjacent to the toggle lever 42. The other end of the motor is hinged to a covered cross brace of the upper frame 39, namely adjacent to the toggle lever 43. The motor therefore lies directly between the two frames 39 and 41, namely crosswise relative to the diagonal coupling brace 50.

The toggle levers 42, 43 cooperate with the horizontal coupling brace 48 and the diagonal coupling brace 50 to form a sort of parallel motion linkage to produce the relative movement between the two frames 39 and 41. This represents a fundamental difference as compared to the kinematics of the bed lifting mechanism described in DE 102 50 075. In the lifting mechanism described in that reference, the motor engages on a cross brace that connects the two horizontal coupling braces to one another. This arrangement kinematically results in a lower parallelogram and an upper parallelogram, both of which have a common horizontal coupling brace. The lower parallelogram is raised by the driving motor. However, in this known arrangement, the diagonal coupling brace transmits the lifting movement of the lower parallelogram to the upper parallelogram.

In the arrangement of the present invention, the kinematics are completely different. The arrangement of the toggle levers in connection with the coupling braces absorbs shearing forces in the horizontal direction that occur during the raising and lowering movements in the inventive kinematics, in which the driving motor extends between the lower and the upper frame 39, 41. The kinematics prevent displacement of the upper frame 39 relative to the lower frame 41 in the longitudinal direction of the bed by the shearing force originating at the motor instead of raising of the upper frame 39.

In one range, a quite precise parallel motion of the upper frame 39 relative to the lower frame 41 is achieved, i.e., the hinge axis of the upper hinge 46 almost remains on the vertical line extending through the axis of the lower hinge 47. This range lies between an angle of approximately 12° between the lower toggle lever arm 45 and a horizontal line and an angle of approximately 80° that is also measured relative to horizontal. In comparison with the arrangement disclosed in DE 102 50 075 A1, the force that must be generated by the motor 41 with an otherwise identical geometry in the longitudinal direction of the spindle motor 41 is reduced by a factor of 2.5.

Figure 4:
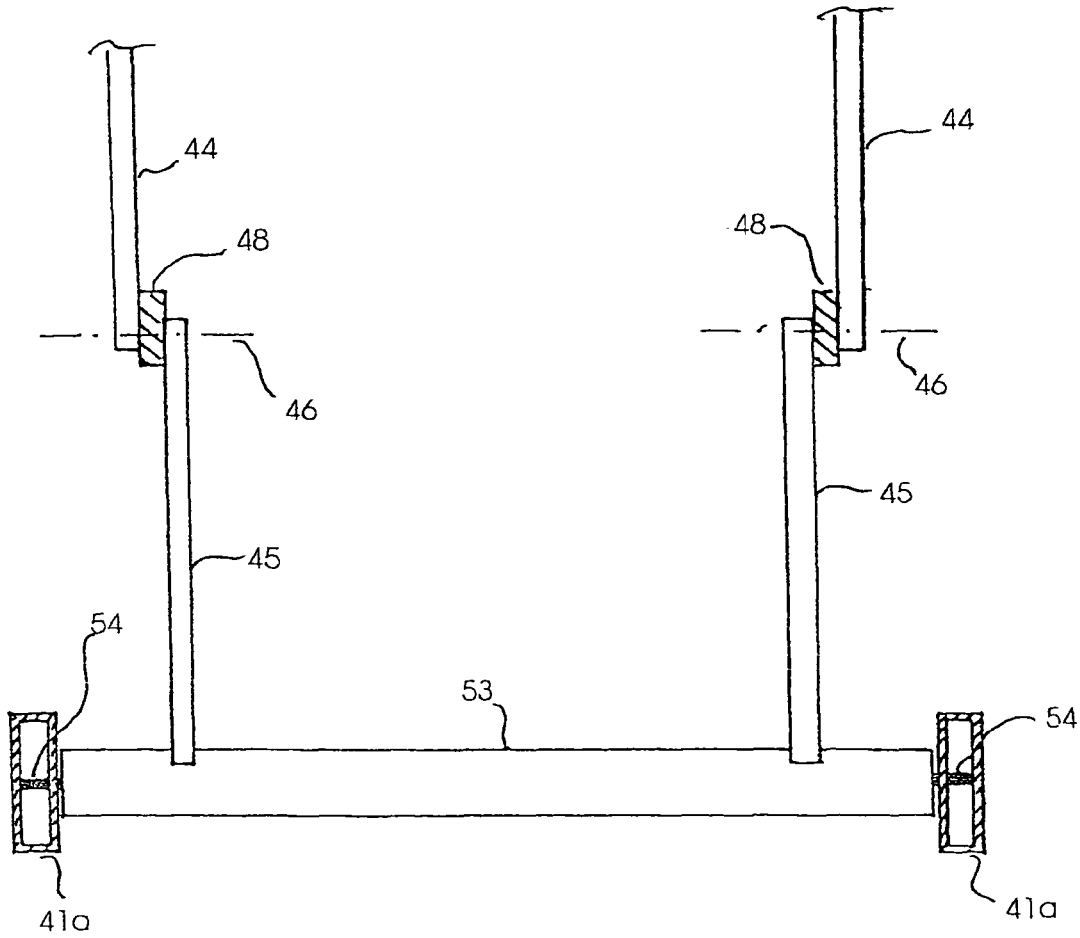
FIG. 4 is a top view of two of the toggle lever arms of the toggle lever pairs on different sides of the bed lifting mechanism of FIG. 3.

In FIG. 3, the toggle lever arms 44 and 45 are directly hinged to the longitudinal rails 39*a*, 41*a* of the upper frame and the lower frame 39, 41. Another option for connecting the toggle lever arms 45 to the lower frame 39 is illustrated in FIG. 4. FIG. 4 provides a cross section through the lower frame approximately in the center of the cross brace 52, with the viewing direction extending in the direction of the foot end. In particular, FIG. 4 is a cross section through the two lower longitudinal rails 41*a*. A tubular shaft 53 that contains bushings on its ends extends between the two longitudinal rails 41*a*. The shaft 53 is rotatably supported between the two longitudinal rails 41*a* by bearing journals 54. The bearing journals 54 extend through corresponding bores in the longitudinal rails 41*a* and point into the bearing bushing contained in the tube 53 with their free end. The two lower toggle lever arms 45 of the right and the left toggle lever pair 42 situated on the foot end are welded to the tube 53 a certain distance from the end faces thereof as shown. The upper end of the toggle lever arms 45 is connected in an articulated fashion to the corresponding toggle lever arms 44 via the horizontal coupling brace 48 as described above.

The illustrated arrangement provides improved tilting stability or tilting resistance of the upper frame 39 relative to the lower frame 41. Since the spindle motor 51 is arranged about centrally between the longitudinal rails 41*a*, a one-sided load that occurs in the chair or sitting position results in an asymmetric load that causes the upper frame 39 to be tilted relative to the lower frame 41. This tilting movement would cause the toggle lever pairs on the side subjected to the load to yield more significantly than on the side subjected to a lesser load. Since the lower levers of at least one set of toggle lever pairs, for example, the toggle lever pairs on the foot end are connected to one another in a torsion-proof fashion, the lower toggle lever arms 45 of the toggle lever pair 42 on the foot end cannot turn relative to one another. This results in a slight tilting movement of the upper frame 39 relative to the lower frame 41.

The bracing can be additionally improved by also providing the connection between the lower toggle lever arms 45 shown in FIG. 4 for the lower toggle lever arms of the toggle lever pair 43 at the head end. If there is sufficient space, it is also possible to analogously couple the upper toggle lever arms 44 to one another in a torsion-proof fashion by means of a tube and to support this tube between the longitudinal rails 41 a as shown in FIG. 4.

A height-adjustable nursing bed is provided that includes a pedestal, in which the upper frame and the lower frame are connected to one another by a total of four toggle lever pairs. The toggle lever pairs on each side of the bed are additionally connected to one another by means of horizontally and diagonally extending coupling braces. The horizontal coupling brace connects the toggle levers in the region of the toggle link while the diagonal coupling brace connects a lower toggle lever arm to an upper toggle lever arm. The motor for raising and lowering the upper frame relative to the lower frame extends directly between these two frames such that the toggle levers and their coupling braces act as a parallel linkage of sorts.

The invention claimed is:

1. A nursing bed including a multi-part bed frame for supporting a mattress, the bed frame having opposing lateral sides and a head end and a foot end comprising:

a bed lifting mechanism that includes a lower frame and an upper frame on which the bed frame is arranged;

a lever mechanism that connects the lower frame to the upper frame, said lever mechanism including on each of the lateral sides of the bed frame:

a head end lower lever and a foot end lower lever, a lower end of each lower lever being pivotably coupled to the lower frame;

a horizontal coupling brace that is pivotally connected to upper ends of both lower levers;

a head end upper lever and a foot end upper lever, a respective upper end of each upper lever being pivotally coupled to the upper frame and a respective lower end of each upper lever being pivotably coupled to the horizontal coupling brace; and a diagonally extending coupling brace that is pivotally connected to a respective one of the upper levers between the upper and lower ends of said lever and to a respective one of the lower levers between the upper and lower ends of said lever; and a linear drive connected between the lower frame and the upper frame extending in diagonal relation to the upper and lower frames for forming an acute angle with said upper and lower frames with the pivotal couplings of the upper lever to the upper frame being horizontally offset from the pivotal couplings of the lower levers with the lower frame.

2. The nursing bed according to claim 1 wherein the corresponding pivotal connections of the lever mechanism included on the lateral sides are arranged coaxial to one another.

3. The nursing bed according to claim 1 wherein the diagonally extending linear drive and the diagonally extending coupling brace are inclined in the same direction.

4. The nursing bed according to claim 1 wherein the diagonally extending linear drive and the diagonally extending coupling brace are inclined in an opposite directions.

5. The nursing bed according to claim 1 wherein at least one of the upper and lower levers on one side of the bed frame and the corresponding lever on the other side of the bed frame are connected to a common torsion element in order to minimize the turning of said levers relative to one another under an uneven load.

6. The nursing bed according to claim 1 wherein the upper and lower levers are recessed relative to an outer contour of the pedestal.

7. The nursing bed according to claim 1 wherein the lower frame comprises a rectangular frame.

8. The nursing bed according to claim 7 wherein the rectangular frame includes a cross brace that serves as an abutment for the linear drive.

9. The nursing bed according to claim 1 wherein the linear drive comprises a spindle motor.

10. The nursing bed according to claim 9 wherein the spindle motor is self-locking.

11. The nursing bed according to claim 1 in which the linear drive is pivotably coupled to the lower frame at a location intermediate the pivotable coupling of the lower levers to the lower frame.

12. The nursing bed according to claim 11 in which the linear drive is pivotably coupled to the upper frame at a location intermediate the pivotable coupling of the upper levers to the upper frame.

* * * * *